US008270140B2

(12) United States Patent
Elizondo et al.

(10) Patent No.: US 8,270,140 B2
(45) Date of Patent: Sep. 18, 2012

(54) SYSTEM AND METHOD FOR CONTROLLING A SET OF BI-STABLE SOLENOIDS FOR ELECTROMAGNETIC LOCKING SYSTEMS

(75) Inventors: Rafael Guillermo Ramos Elizondo, Monterrey (MX); Antonio Vidaurri Ojeda, Monterrey (MX)

(73) Assignee: RFID Mexico, S.A. DE C.V, Nuevo Leon (MX)

( * ) Notice: Subject to any disclaimer, the term of this patent is extended or adjusted under 35 U.S.C. 154(b) by 241 days.

(21) Appl. No.: 12/576,558

(22) Filed: Oct. 9, 2009

(65) Prior Publication Data

US 2010/0149718 A1 Jun. 17, 2010

Related U.S. Application Data

(60) Provisional application No. 61/104,370, filed on Oct. 10, 2008.

(51) Int. Cl.
*H01H 9/00* (2006.01)

(52) U.S. Cl. ..... 361/139; 361/160

(58) Field of Classification Search ..... 361/139, 361/160

See application file for complete search history.

(56) References Cited

U.S. PATENT DOCUMENTS 4,920,304 A * 4/1990 Antonowitz ..... 318/466
6,351,366 B1 * 2/2002 Alexanian et al. ..... 361/189

* cited by examiner

*Primary Examiner* — Danny Nguyen
(74) *Attorney, Agent, or Firm* — Young & Thompson

(57) ABSTRACT

A system and a method for controlling a set of bi-stable solenoids for locking applications which eliminates the direct connection of the power supply and solenoid by introducing a capacitor and a switch between the power supply and solenoid, thus eliminating the need of a dedicated h-bridge for every solenoid, and reducing the control lines required for each solenoid such that after the initial control lines, every subsequent solenoid requires only one control line to select the appropriate solenoid.

4 Claims, 4 Drawing Sheets

SYSTEM AND METHOD FOR CONTROLLING A SET OF BI-STABLE SOLENOIDS FOR ELECTROMAGNETIC LOCKING SYSTEMS

BACKGROUND OF THE INVENTION

A. Field of the Invention

The present invention is related to electromagnetic locking systems for locking and unlocking access means such as doors, drawers, etc. and more particularly to a system and method for controlling a set of bi-stable solenoids for battery powered or low power electromagnetic locking systems comprising the use of a capacitor to provide the correct voltage amplitude for the release action of the solenoid and the separation of the battery from the solenoid at the actuation moments, thus eliminating instant high power requirements to the power source.

B. Description of Related Art

A bi-stable solenoid is a device that requires power to change its state but not to hold it. This is ideal for low power applications because it eliminates the need to provide power for holding a particular status (i.e. unlocking a mechanism). This is also very important because some applications require that a particular status be maintained during undetermined periods of time (i.e. unlocking a door for a certain period of time.)

A bi-stable solenoid requires two important control parameters, polarity and voltage amplitude. For example, if the bi-stable solenoid is used In a locking system for retracting (which comprises a "retracted" or unlocked status) or release (which comprises a "released" or locked status) a plunger, it is necessary that a full rated "positive" polarity power amplitude be provided to the solenoids by a driving circuit in order to change the status of the system to "retracted". In order to change the status of the system to "released", the driving circuit needs to provide a lesser "negative" polarity power amplitude. The exact difference between the "retract" and "release" power amplitudes varies with each different application and varies depending on solenoid construction.

A typical control system for a bi-stable solenoid consists of four transistors configured to provide power in either "positive" or "negative" polarity. Such circuit is commonly referred to as an H-bridge, which requires the control circuit to connect a first and a fourth switch for one polarity and a second and a third switch for the reverse polarity.

A control circuit must be provided for each solenoid that the system must control; this requires a great amount of driving lines from the controller and introduces a parasitic power requirement from every transistor.

Additionally a regular driving circuit is needed to change the voltage amplitude for the second polarity in order to provide the bi-stable solenoid with the adequate amount of voltage to release its plunger.

Furthermore, when the locking system main power source comprises a low power source such as a battery or solar cells, the power requirements during instant surges of power required from the locking system, may not be completely supplied by said low power sources or can have adverse effects such as quick battery degeneration, excessive noise on the power supply lines).

In view of the above referred problems, applicant developed a system and a method for controlling a set of bi-stable solenoids for locking applications which eliminates the direct connection of the power supply and solenoid by introducing a capacitor and a switch between the power supply and solenoid. Additionally it eliminates the need of a dedicated h-bridge for every solenoid, thus reducing the control lines required for each solenoid such that after the initial control lines, every subsequent solenoid requires only one control line to select the appropriate solenoid.

SUMMARY OF THE INVENTION

It is therefore a main objet of the present invention to provide a system and method for controlling a set of bi-stable solenoids for locking applications.

It is another main object of the present invention to provide a system and method of the above referred nature which eliminates the direct connection of the power supply and solenoid by introducing a capacitor and a switch between the power supply and solenoid.

It is an additional object of the present invention to provide a system and method of the above referred nature which eliminates the need of a dedicated h-bridge for every solenoid, thus reducing the control lines required for each solenoid such that after the initial control lines, every subsequent solenoid requires only one control line to select the appropriate solenoid.

It is and further object of the present invention, to provide a system and method of the above disclosed nature which eliminates sudden high power requirements to the power source, by using a capacitor to provide the correct voltage amplitude for the release action of the solenoid and separating the battery from the solenoid at the actuation moments.

These and other objects and advantages of the system and method for controlling a set of bi-stable solenoids for electromagnetic locking systems of the present invention will become apparent to those persons having an ordinary skill in the art, from the following detailed description of the embodiments of the invention which will be made with reference to the accompanying drawings.

DETAILED DESCRIPTION OF THE INVENTION

The system and method for controlling a set of bi-stable solenoids for electromagnetic locking systems of the present invention will be described making reference to the accompanying drawings and to a preferred embodiment.

Figure 1:
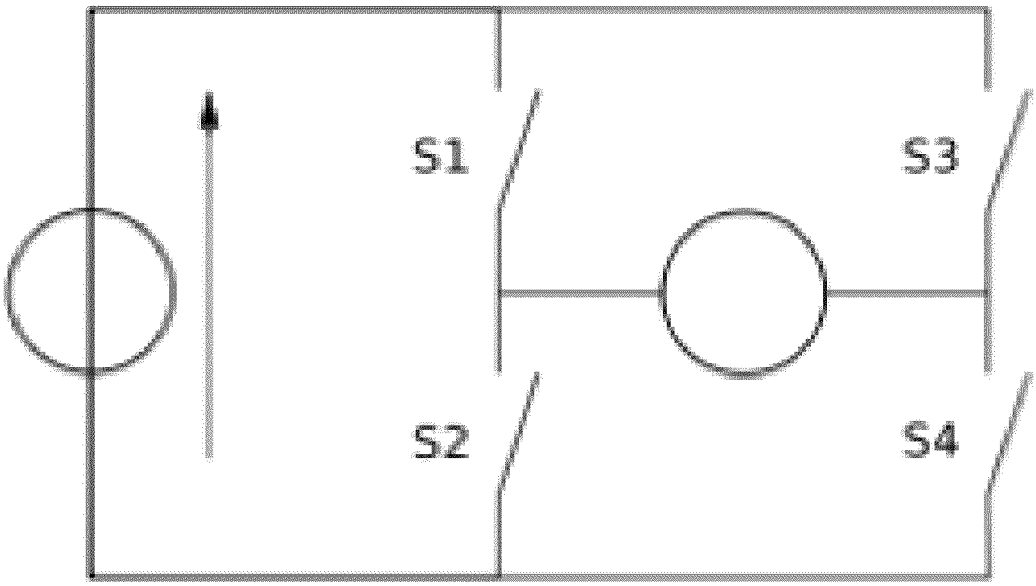
FIG. 1, comprises a scheme of a prior art bi-stable solenoid control circuit.

For comparison purposes, FIG. 1 shows a prior art bi-stable solenoid control circuit comprising four transistors (not shown) configured in a way that can provide power in either "positive" or "negative" polarity, and four switches (S1, S2, S3 and S4). Said circuit is commonly referred to as an H-bridge, which requires the control circuit to connect switch S1 and S4 for one polarity and switch S2 and S3 for the reverse polarity.

The system for controlling a set of bi-stable solenoids of the present invention comprises:

a power supply a capacitor charge circuit connected to the power supply;

a polarity control circuit connected to the capacitor charge circuit; and a solenoid select circuit connected to the polarity control circuit.

Figure 2:
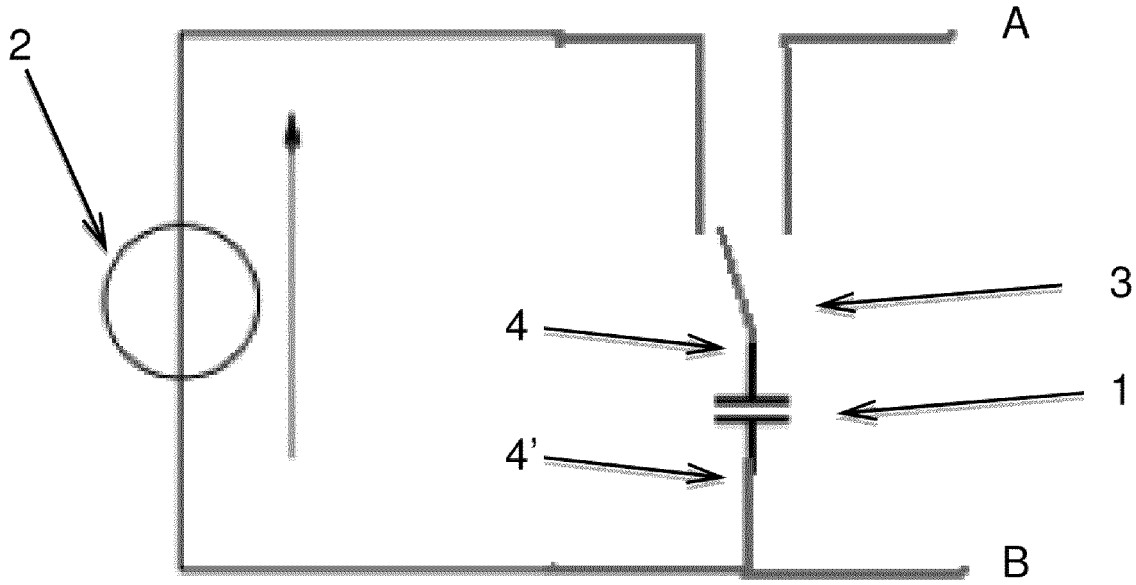
FIG. 2 comprises a scheme of the capacitor charge circuit of the bi-stable solenoid control circuit of the present invention.
Figure 3:
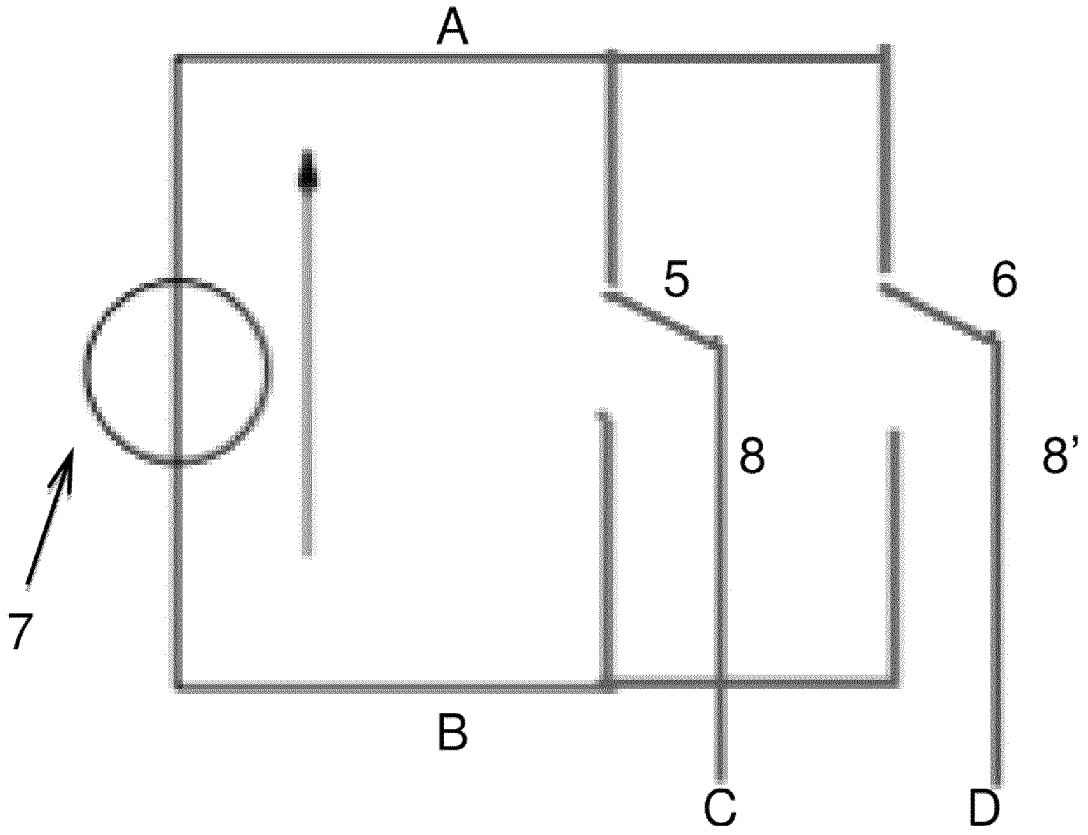
FIG. 3 comprises a scheme of the polarity control circuit of the bi-stable solenoid control circuit of the present invention.

The capacitor charge circuit of the present invention shown in FIG. 2, comprises a capacitor 1 located parallely to the power supply 2, having a switch 3 that connects the positive lead 4 of the capacitor 2 to either the power supply 2 or to a polarity control circuit shown in FIG. 3 by means of power lead A. A power lead B connects the negative lead 4' of the capacitor to the power source and is directly connected to said polarity control circuit. This allows the capacitor 1 to charge from the power supply 2 (which may comprise a battery) and be ready to provide the power requirements to the solenoid.

The voltage output of a capacitor follows a dropping curve that is ideal for the release action of the bi-stable solenoid, thus eliminating the need for a dual voltage amplitude system and giving a better control of the release action. This is important because it eliminates several complexities and inefficiencies in the generation of a second driving voltage that usually employs a resistor to dissipate the difference in voltages in the form of heat. This is not power efficient and can lead to lower component life expectancy. Introducing a power efficient regulation circuit increases the cost and complexity of the system.

Figure 4:
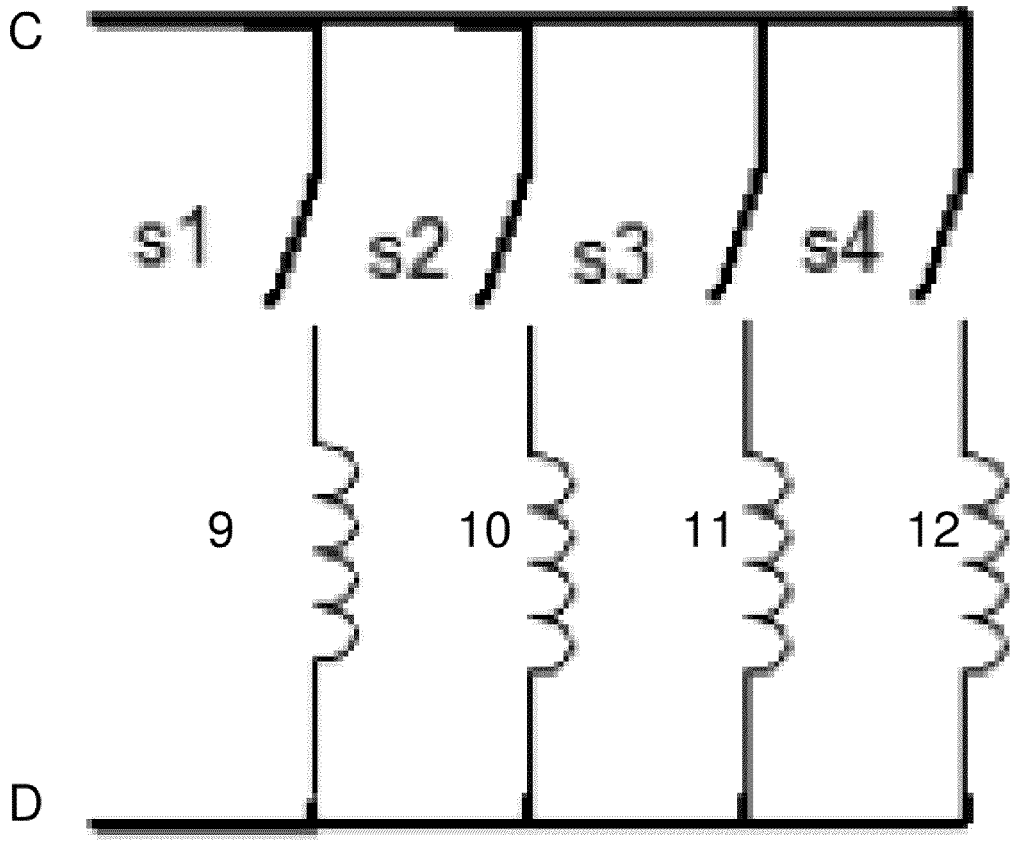
FIG. 4 comprises a scheme of the solenoid select circuit of the bi-stable solenoid control circuit of the present invention.

The polarity control circuit of the present invention shown in FIG. 3, is comprised by a first 5 and a second 6 switch, each having a first and a second pole connected to the positive and negative power leads of the capacitor charge circuit 7 respectively by means of power leads A and B, and a each having a center pole 8, 8' each connected to the solenoid selector circuit shown in FIG. 4 by means of power leads C and D. This polarity control circuit allows to achieve the following states: "positive/positive" (P/P), "negative/negative" (N/N), "positive/negative" (P/N), "negative/positive" (N/P). Since both N/N, P/P states share the same charge, they are not used for the solenoid circuit. These states however pose no threat to the power supply or other parts of the system, whereas an incorrect selection of switches in a regular h-bridge will produce a short circuit. (i.e. switches 1 and 2 in the scheme of FIG. 1).

The solenoid selector circuit of the present invention shown in FIG. 4 comprising four solenoids 9, 10, 11, 12, each having a first and a second pole, wherein the first pole of each solenoid is connected to a respective switch (S1, S2, S3, S4). Said solenoid selector circuit receiving power leads C and D from the polarity control circuit. Power lead D is connected to the second pole of all solenoids and lead C is connected to each solenoid switch 10 in the circuit (as a common to all the switches). When the control circuit enables one or several of the solenoids, the polarity control circuit is in essence connected to all those solenoids.

The bi-stable solenoid control circuit of the present invention is able to control any number of solenoids simultaneously but can only apply the same state change to all selected solenoids simultaneously (solenoids 9 and 10 to the open position). If two different state changes are required, the control system must generate the first and subsequent state changes in sequence (i.e. solenoid 9 and 10 to the open position, then solenoid 11 and 12 to the closed position).

Capacitor Curve Determination:

The value of the capacitor (and therefore the parameters of the voltage curve) is a factor that determines several parameters, including but not limited to power supply voltage, rated solenoid voltage, resistance, impedance and timing requirements of said solenoid.

As was previously described, the solenoid release action requires a lower voltage than the retract action due to the mechanical nature of the system. Usually the solenoid is provided with a lower constant voltage during retraction (i.e. 8 volts to release in a 12 v rated solenoid). It was realized after cautious observation that the solenoid works better (faster and more reliably) if it is provided with a full rated voltage (i.e. 12 v) at the initial stage of the solenoid release, followed by a dropping curve that crosses the release voltage after a determined amount of time (depending on the solenoid size and magnetic parameters), subsequently withdrawing the voltage completely and thus allowing the solenoid release assist spring to complete the movement. The capacitor is able to provide said voltage dropping curve to the solenoid.

The method for controlling a set of bi-stable solenoids for locking applications will now be described in accordance with a preferred embodiment thereof, said method comprising:

providing a power supply providing a capacitor charge circuit comprising a capacitor located parallely to the power supply, having a switch that connects the positive lead of the capacitor to either the power supply or to a polarity control circuit by means of a first power lead. A second power lead connects the negative lead of the capacitor to the power source to said polarity control circuit;

providing a polarity control circuit comprised by a first and a second switch, each having a first and a second pole connected to the positive and negative power leads of the capacitor charge circuit respectively by means of the first and a second power lead, and each having a center pole each connected to a solenoid selector circuit by means of a fourth and a fifth power lead respectively. Said polarity control circuit allowing to achieve the following states: "positive/positive" (P/P), "negative/negative" (N/N), "positive/negative" (P/N), "negative/positive" (N/P);

providing a solenoid selector circuit connected to the polarity control circuit, said solenoid selector circuit having four solenoids, each having a first and a second pole, wherein the first pole of each solenoid is connected to a respective switch. Said solenoid selector circuit receiving fourth and fifth power lead from the polarity control circuit. The fifth power lead is connected to the second pole of all solenoids and the fourth lead is connected to each solenoid switch in the circuit (as a common to all the switches). When the control circuit enables one or several of the solenoids, the polarity control circuit is in essence connected to all those solenoids;

enabling one of the switches in the polarity control system to generate either positive polarity (switch 5), or negative polarity (switch 6);

setting the solenoid control switches to enable the solenoid (s) s1, s2, s3, s4, that are required to change state changing the capacitor switch to connect its power lead to the polarity control circuit and to the solenoids. If a release action was performed, the solenoid will benefit of the voltage curve generated by the capacitor as it discharges, allowing for a correct transition from the retracted to the released state. If a retraction of the solenoid was performed, the voltage curve does not affect the solenoid operation because the retraction happens before the voltage curve significantly lowers the output voltage of the capacitor; and returning the capacitor to its default state and release all other switches.

Although in the above described preferred embodiment of the invention, the system and method for controlling a ser of bi-stable solenoids controls four solenoid, it must be understood that it has the capability to control more than four solenoids or at least one solenoid.

Finally it must be understood that the system and method for controlling a set of bi-stable solenoids for electromagnetic locking systems of the present invention, is not limited exclusively to the embodiment above described and illustrated and that the persons having ordinary skill in the art can, with the teaching provided by the invention, to make modifications to the system and method for controlling a set of bi-stable solenoids for electromagnetic locking systems of the present invention, which will clearly be within of the true inventive concept and of the scope of the invention which is claimed in the following claims.

What is claimed is:

1. A system for controlling a set of bi-stable solenoids for electromagnetic locking systems comprising:

a power supply;

a capacitor charge circuit connected to the power supply;

a polarity control circuit connected to the capacitor charge circuit; and a solenoid select circuit comprised of a set of solenoids and connected to the polarity control circuit, the capacitor charge circuit comprising i) a capacitor for providing a decreasing voltage in accordance with a voltage dropping curve to the set of solenoids, said capacitor located in parallel to the power supply, ii) a switch connecting a positive lead of the capacitor to either the power supply or to the polarity control circuit by a first power lead, and iii) a second power lead connects a negative lead of the capacitor to the power source and is directly connected to said polarity control circuit, the polarity control circuit comprising a first and a second switch, each switch having a first and a second pole connected to the positive and the negative power lead of the capacitor charge circuit respectively by means of a first and a second power lead, and each switch having a center pole connected to the solenoid selector circuit by means of a third and a fourth power lead, and each solenoid of the solenoid selector circuit having a first and a second pole, wherein the first pole of each solenoid is connected to a respective switch, said solenoid selector circuit receiving a first and a second power lead from the polarity control circuit, and wherein i) the second power lead is connected to the second pole of all the solenoids and ii) the first power lead is connected to each solenoid switch in the circuit as a common to all the switches.

2. A method for controlling a set of bi-stable solenoids for electromagnetic locking systems comprising:

providing a power supply;

providing a capacitor charge circuit comprising a capacitor located in parallel to the power supply, having a switch that connects a positive lead of the capacitor to either the power supply or to a polarity control circuit by means of a first power lead, and a second power lead connects a negative lead of the capacitor to the power source and to said polarity control circuit;

providing a polarity control circuit comprised by a first and a second switch, each having a first and a second pole connected to the positive and negative power leads of the capacitor charge circuit respectively by means of the first and a second power lead, and each having a center pole each connected to a solenoid selector circuit by means of a third and a fourth power lead respectively;

providing a solenoid selector circuit connected to the polarity control circuit, said solenoid selector circuit having at least one solenoid, each having a first and a second pole, wherein the first pole of each solenoid is connected to a respective switch, and said solenoid selector circuit receiving fourth and fifth power lead from the polarity control circuit wherein the fifth power lead is connected to the second pole of all solenoids and the fourth lead is connected to each solenoid switch in the circuit, as a common to all the switches;

enabling one of the switches in the polarity control circuit to generate either positive polarity or negative polarity;

setting the solenoid selector circuit switches to enable the at least one solenoid that are required to change state changing the capacitor switch to connect its power lead to the polarity control circuit and to the solenoids; and returning the capacitor to its default state and release all other switches.

3. The method of claim 2, wherein the capacitor charge circuit comprising the capacitor is for providing a decreasing voltage in accordance with a voltage dropping curve to the at least one solenoid.

4. A system for controlling a set of bi-stable solenoids for electromagnetic locking systems comprising:

a power supply;

a capacitor charge circuit connected to the power supply;

a polarity control circuit connected to the capacitor charge circuit, wherein the polarity control circuit is comprised by a first and a second switch, each switch having a first and a second pole connected to a positive and a negative power lead of the capacitor charge circuit respectively by means of a first and a second power lead, and each switch having a center pole connected to the solenoid selector circuit by a third and a fourth power lead; and a solenoid select circuit connected to the polarity control circuit, wherein the solenoid selector circuit comprises plural solenoids, each solenoid having a first and a second pole, wherein the first pole of each solenoid is connected to a respective switch, said solenoid selector circuit receiving the first and the second power lead from the polarity control circuit, and wherein i) the second power lead is connected to the second pole of all the solenoids and ii) the first power lead is connected to each solenoid switch as a common to all the switches.

* * * * *